US012429264B2

(12) United States Patent
Toyooka et al.

(10) Patent No.: US 12,429,264 B2
(45) Date of Patent: Sep. 30, 2025

(54) REFRIGERATION CIRCUIT AND REFRIGERATION DEVICE

(71) Applicant: PHC Holdings Corporation, Tokyo (JP)

(72) Inventors: Takashi Toyooka, Saitama (JP); Minoru Suto, Gunma (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 171 days.

(21) Appl. No.: 18/108,973

(22) Filed: Feb. 13, 2023

(65) Prior Publication Data

US 2023/0184472 A1 Jun. 15, 2023

Related U.S. Application Data

(63) Continuation of application No. PCT/JP2021/045834, filed on Dec. 13, 2021.

(30) Foreign Application Priority Data

Jan. 15, 2021 (JP) ..... 2021-004787

(51) Int. Cl.
*F25B 43/04* (2006.01)
*F25B 39/02* (2006.01)
*F28D 9/00* (2006.01)

(52) U.S. Cl.
CPC ..... *F25B 43/043* (2013.01); *F25B 39/02* (2013.01); *F28D 9/0062* (2013.01)

(58) Field of Classification Search
CPC ..... C09K 5/041; F25J 1/0055; F25B 2400/23; F25B 9/006; F25B 39/02
See application file for complete search history.

(56) References Cited

U.S. PATENT DOCUMENTS 1,680,145 A * 8/1928 Forssblad ..... F28F 3/083 165/95
5,617,739 A 4/1997 Little
(Continued)

FOREIGN PATENT DOCUMENTS

JP 2005-009851 A 1/2005
JP 2005-114354 A 4/2005
JP 5128424 B2 1/2013

OTHER PUBLICATIONS

Extended European Search Report dated Dec. 13, 2023 issued in the corresponding European Patent Application No. 21918131.0.
(Continued)

*Primary Examiner* — Joel M Attey
*Assistant Examiner* — Meraj A Shaikh
(74) *Attorney, Agent, or Firm* — Rimon P.C.

(57) ABSTRACT

A refrigeration circuit includes: a gas-liquid separator into which a gas-liquid two-phase refrigerant flowed out from a condenser flows, the gas-liquid separator being configured to separate the gas-liquid two-phase refrigerant into a vapor phase refrigerant and a liquid phase refrigerant; and a plate heat exchanger including a first heat exchanging part and a second heat exchanging part, the first heat exchanging part being a part where the vapor phase refrigerant flowed out from the gas-liquid separator and the liquid phase refrigerant flowed out from the gas-liquid separator exchange heat, the second heat exchanging part being a part where the vapor phase refrigerant flowed out from the first heat exchanging part and a returning refrigerant flowed out from an evaporator exchange heat.

8 Claims, 4 Drawing Sheets

(56) References Cited

U.S. PATENT DOCUMENTS

| | | | | |
|---|---|---|---|---|
| 5,724,832 | A | 3/1998 | Little et al. | |
| 6,065,305 | A * | 5/2000 | Arman | F25J 1/0097 62/619 |
| 6,962,059 | B2 * | 11/2005 | Okaza | F25B 31/002 62/468 |
| 7,478,540 | B2 * | 1/2009 | Flynn | F25B 9/006 62/197 |
| 10,502,483 | B2 * | 12/2019 | Gushanas | F25J 1/0022 |
| 10,663,221 | B2 * | 5/2020 | Ducote, Jr. | F25J 1/0055 |
| 11,408,673 | B2 * | 8/2022 | Ducote, Jr. | F25J 1/0291 |
| 2004/0244411 | A1 | 12/2004 | Ichimura et al. | |
| 2013/0292099 | A1 * | 11/2013 | Cook | F28D 9/0037 165/145 |
| 2021/0041188 | A1 * | 2/2021 | Walsh | F28F 9/0268 |

OTHER PUBLICATIONS

International Search Report dated Jan. 11, 2022 issued in International Patent Application No. PCT/JP2021/045834, with English translation.

* cited by examiner

REFRIGERATION CIRCUIT AND REFRIGERATION DEVICE

CROSS-REFERENCE OF RELATED APPLICATIONS

This application is a Continuation of International Patent Application No. PCT/JP2021/045834, filed on Dec. 13, 2021, which in turn claims the benefit of Japanese Patent Application No. 2021-004787, filed on Jan. 15, 2021, the entire disclosures of which Applications are incorporated by reference herein.

TECHNICAL FIELD

The present disclosure relates to a refrigeration circuit and a refrigeration device.

BACKGROUND ART

A refrigeration circuit includes a heat exchanger for cooling circulating refrigerant so as to obtain the temperature of the refrigerant required at an evaporator. For example, PTL 1 discloses a refrigeration circuit including a flow divider for separating gas and liquid, and a double tube heat exchanger for exchanging heat between the vapor phase refrigerant flowed out from the flow divider, and the liquid phase refrigerant flowed out from the flow divider and the refrigerant returning to the compressor from the evaporator.

CITATION LIST

Patent Literature

PTL 1
Japanese Patent Publication No. 5128424

SUMMARY OF INVENTION

Technical Problem

In refrigeration circuits, lower temperatures may be required depending on the object to be cooled. This requires enhancement in heat exchanging efficiency, but the increase in size of the heat exchanger and in number of heat exchangers may cause a problem in terms of the mounting space of the heat exchanger.

To solve the known problems of the related art, an object of the present disclosure is to reduce the size of a heat exchanger and improve the heat exchanging efficiency in a refrigeration circuit and a refrigeration device.

Solution to Problem

To achieve the above-mentioned object, a refrigeration circuit in the present disclosure includes: a gas-liquid separator into which a gas-liquid two-phase refrigerant flowed out from a condenser flows, the gas-liquid separator being configured to separate the gas-liquid two-phase refrigerant into a vapor phase refrigerant and a liquid phase refrigerant; and a plate heat exchanger including a first heat exchanging part and a second heat exchanging part, the first heat exchanging part being a part where the vapor phase refrigerant flowed out from the gas-liquid separator and the liquid phase refrigerant flowed out from the gas-liquid separator exchange heat, the second heat exchanging part being a part where the vapor phase refrigerant flowed out from the first heat exchanging part and a returning refrigerant flowed out from an evaporator exchange heat.

In addition, to achieve the above-mentioned object, a refrigeration device in the present disclosure includes the above-described refrigeration circuit.

Advantageous Effects of Invention

With the refrigeration circuit and the refrigeration device according to embodiments of the present disclosure, it is possible to reduce the size of the heat exchanger and improve the heat exchanging efficiency.

DESCRIPTION OF EMBODIMENTS

Figure 1:
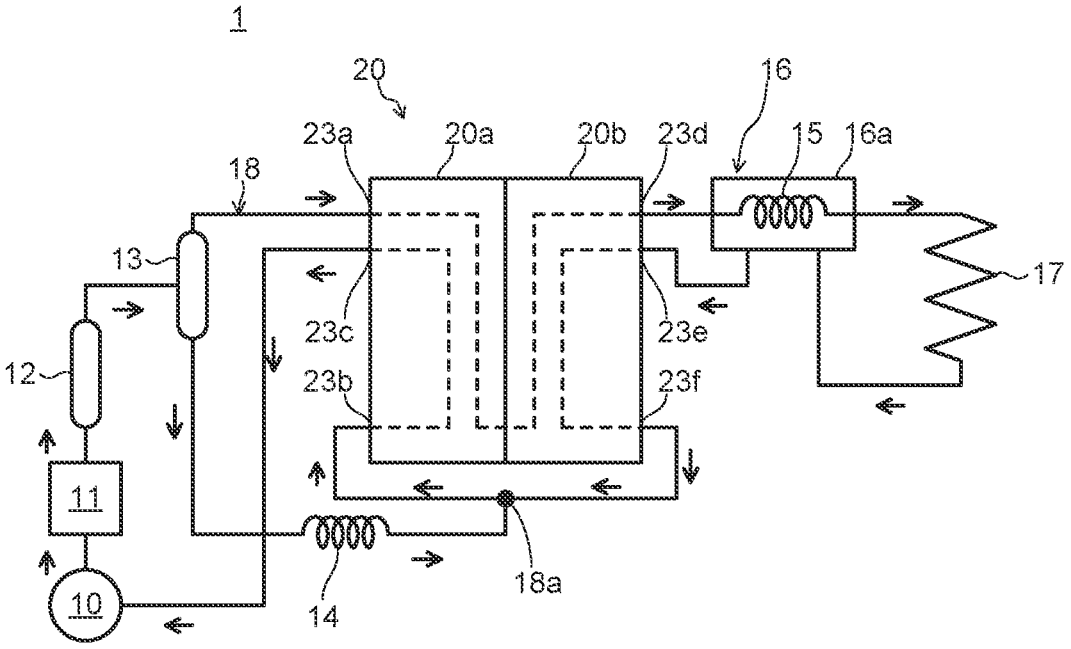
FIG. 1 is a schematic view of a refrigeration circuit in an embodiment of the present disclosure.

Refrigeration circuit 1 according to an embodiment of the present disclosure is described below with reference to the drawings. Refrigeration circuit 1 is used for a refrigeration device such as an ultra-low-temperature freezer. As illustrated in FIG. 1, refrigeration circuit 1 includes compressor 10, condenser 11, dryer 12, gas-liquid separator 13, first decompressor 14, plate heat exchanger 20, second decompressor 15, double tube heat exchanger 16, and evaporator 17.

A gas-liquid two-phase refrigerant, which is a mixture of a vapor phase refrigerant and a liquid phase refrigerant, enters gas-liquid separator 13, and gas-liquid separator 13 separates the gas-liquid two-phase refrigerant into a vapor phase refrigerant and a liquid phase refrigerant. The vapor phase refrigerant flows out from the upper part of gas-liquid separator 13. The liquid phase refrigerant flows out from the lower part of gas-liquid separator 13. First decompressor 14 is a capillary tube, for example.

Plate heat exchanger 20 includes first heat exchanging part 20*a* and second heat exchanging part 20*b*. First heat exchanging part 20*a* exchanges heat between the vapor phase refrigerant flowed out from gas-liquid separator 13, and a mixed refrigerant of a returning refrigerant and the liquid phase refrigerant flowed out from gas-liquid separator 13. The returning refrigerant is a refrigerant flowing out from evaporator 17 and returning to compressor 10.

Second heat exchanging part 20*b* exchanges heat between the vapor phase refrigerant flowed out from first heat exchanging part 20*a* and the returning refrigerant flowed out from evaporator 17. Details of plate heat exchanger 20 are described later.

The inner pipe of double tube heat exchanger 16 is second decompressor 15. Second decompressor 15 is a capillary tube, for example. The returning refrigerant flowed out from evaporator 17 flows through outer pipe 16*a* of double tube heat exchanger 16. That is, in double tube heat exchanger 16, the returning refrigerant and the refrigerant flowing through second decompressor 15 exchange heat.

The above-described devices are connected by pipe 18 such that the refrigerant ejected from compressor 10 returns to compressor 10 again.

The refrigerant illustrated in FIG. 1 circulates in the arrow direction. More specifically, the refrigerant flows through compressor 10, condenser 11 and dryer 12 in this order, and then flows into gas-liquid separator 13. The refrigerant is separated into a vapor phase refrigerant and a liquid phase refrigerant at gas-liquid separator 13.

The vapor phase refrigerant flowed out from gas-liquid separator 13 flows through first heat exchanging part 20*a*, second heat exchanging part 20*b*, second decompressor 15 and evaporator 17 in this order. Further, the returning refrigerant flowed out from evaporator 17 flows through outer pipe 16*a* of double tube heat exchanger 16 and second heat exchanging part 20*b* in this order. The returning refrigerant flowed out from second heat exchanging part 20*b* flows out from gas-liquid separator 13, merges at confluence part 18*a* with the liquid phase refrigerant flowed through first decompressor 14, and returns to compressor 10 through first heat exchanging part 20*a*.

Note that the gas-liquid two-phase refrigerant is a mixture of a vapor phase refrigerant and a liquid phase refrigerant. More specifically, the gas-liquid two-phase refrigerant is a mixture of one or more refrigerants respectively selected from among the liquid phase refrigerant listed in the group A and the vapor phase refrigerant listed in the group B shown in Table 1. Note that the liquid phase refrigerant is a refrigerant with a boiling point of −55° C. or higher, and liquefies before flowing into gas-liquid separator 13. In addition, the vapor phase refrigerant is a refrigerant with a boiling point lower than −55° C.

TABLE 1

| | Refrigerant No. | Name | Boiling Point (° C.) |
|---|---|---|---|
| Group A | R245fa | 1,1,1,3,3-Pentafluoropropane | 15.3 |
| | R600 | Normal butane | −0.55 |
| | R600a | Isobutane | −11.7 |
| | R1233zd | trans-1-chloro-3,3,3-trifluoropropene | 19.0 |
| | R1224yd(Z) | (Z)-1-Chloro-2,3,3,3,-tetrafluoropropene | 15.0 |
| | R1336mzz(Z) | 1,1,1,4,4,4,-hexafluoro-2-butane | 33.0 |
| | R1234yf | 2,3,3,3-tetrafluoro-1-propene | −29.0 |
| | R1234ze(E) | trans-1,3,3,3-tetrafluoroprop-1-ene | −19.0 |
| | R290 | Propane | −42.1 |
| | R32 | Difluoroethane | −51.7 |
| | R-1270 | Propylene | −47.7 |
| | R125 | Pentafluoroethane | −48.1 |
| Group B | R23 | Trifluoromethane | −82.1 |
| | R508A | Refrigerant made by mixing trifluoromethane (R23) and hexafluoroethane (R116) at 39 wt % and 61 wt %. | −85.7 |
| | R508B | Refrigerant made by mixing trifluoromethane (R23) and hexafluoroethane (R116) at 46 wt % and 54 wt %. | −86.9 |
| | R170 | Ethane | −89.0 |
| | R744 | Carbon dioxide | −78.4 |
| | R14 | Tetrafluoromethane | −128.1 |
| | R-1150 | Ethylene | −104.0 |
| | Kr | Krypton | −152.3 |
| | R50 | Methane | −161.5 |
| | R740 | Argon | −185.8 |

Figure 2:
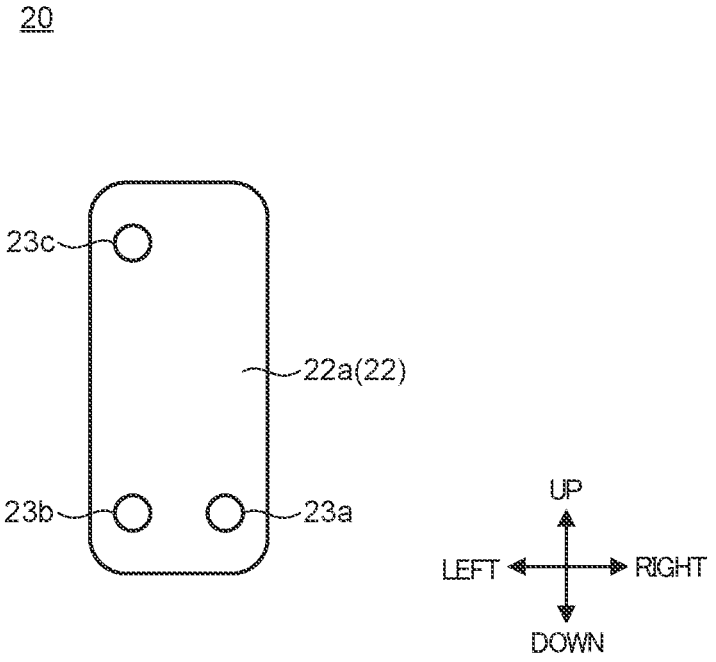
FIG. 2 is a front view of a plate heat exchanger illustrated in FIG. 1.

Next, details of plate heat exchanger 20 are described with reference to FIGS. 2 to 5. Note that for convenience of the description below, the upper side and lower side in FIG. 2 are the upper side and lower side of plate heat exchanger 20. Likewise, the left side and right side are the left side and right side of plate heat exchanger 20, and the near side and depth side in the drawing are the front side and rear side of plate heat exchanger 20.

Plate heat exchanger 20 is a brazed plate heat exchanger. Plate heat exchanger 20 includes a plurality of heat transfer plates 21 and cover plates 22. Twelve heat transfer plates 21 are provided in the present embodiment. Heat transfer plate 21 and cover plate 22 are examples of "plate". Heat transfer plate 21 and cover plate 22 are plate members with a rectangular shape in front view.

Figure 3:
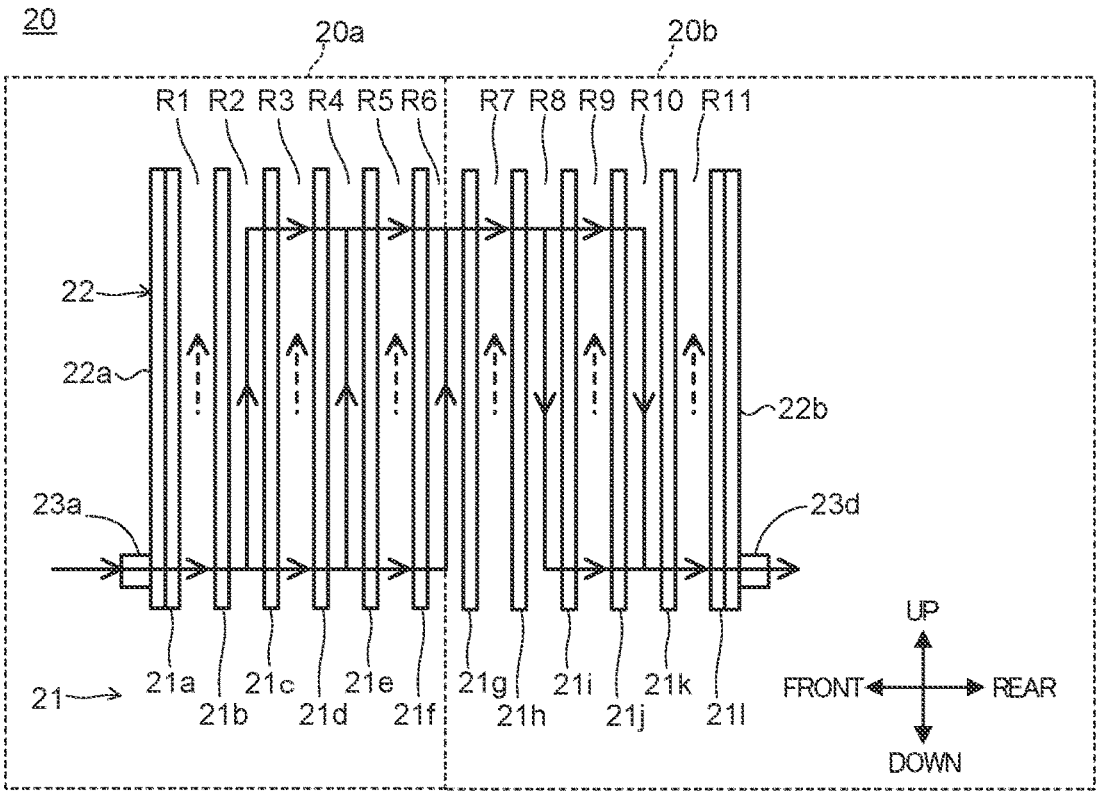
FIG. 3 is a schematic view illustrating a flow of a refrigerant in the plate heat exchanger.

The plurality of heat transfer plates 21 is disposed side by side along the front-rear direction with their plate surfaces parallel to each other and with a predetermined distance therebetween (FIG. 3). In this manner, channel R through which refrigerant flows is formed between heat transfer plates 21 adjacent to each other. More specifically, first channel R1 to eleventh channel R11 are formed in this order from the front side to the rear side.

Figure 4:
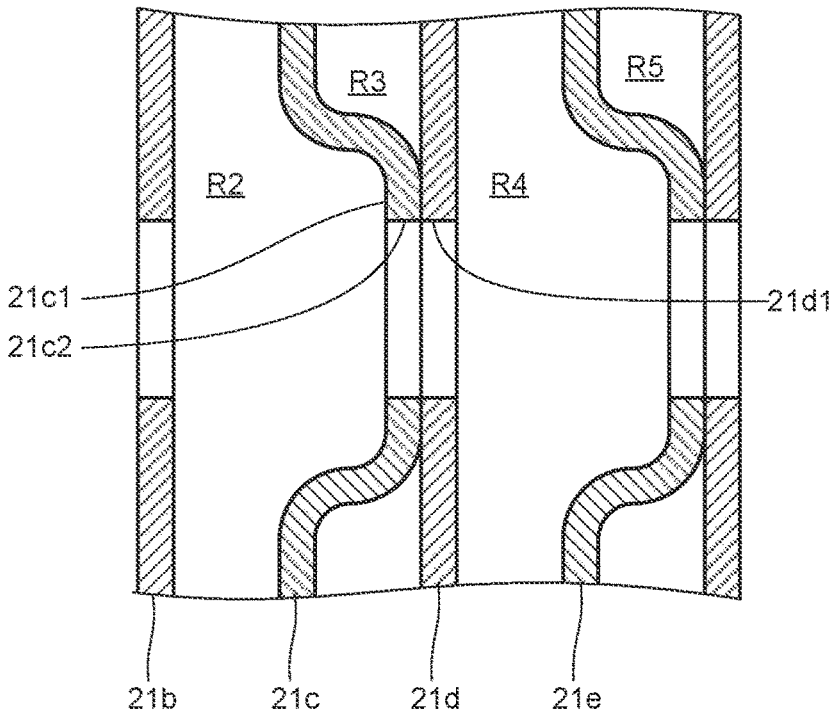
FIG. 4 is a partially enlarged sectional view of the plate heat exchanger.

In addition, second channel R2 and fourth channel R4 are formed so as to be communicated with each other (FIG. 4). Further, second and fourth channels R2 and 4 are formed so as not to communicate with adjacent channel R. More specifically, in third heat transfer plate 21*c* making up second channel R2, protruding part 21*c*1 protruding in a columnar shape toward adjacent fourth heat transfer plate 21*d* making up fourth channel R4 and through hole 21*c*2 formed at the protruding end of protruding part 21*c*1 are formed.

Through hole 21*c*2 is communicated with through hole 21*d*1 formed in fourth heat transfer plate 21*d*. In addition, the peripheries of through holes 21*c*2 and 21*d*1 are in contact with each other and welded. In this manner, second channel R2 and fourth channel R4 communicate with each other, and do not communicate with third channel R3 located between second and fourth channels R2 and R4.

In addition, with similar configurations, channels R adjacent to each other in fourth, sixth, eighth, tenth channels R4, R6, R8 and R10 are configured to communicate with each other. Further, with similar configurations, channels R adjacent to each other in first, third and fifth channels R1, R3 and R5 are configured to communicate with each other. Further, with similar configurations, channels R adjacent to each other in seventh, ninth and eleventh channels R7, R9 and R11 are configured to communicate with each other. Note that the above-described channels R adjacent to each other are configured to communicate with each other on the upper side and lower side of heat transfer plate 21, except between sixth channel R6 and eighth channel R8. The part between sixth channel R6 and eighth channel R8 are configured to communicate on the upper side of heat transfer plate 21.

Cover plate 22 is disposed at the front ends and rear ends of the plurality of heat transfer plates 21 disposed side by side. Each cover plate 22 is disposed such that the plate surfaces of each cover plate 22 and opposite heat transfer plate 21 are in contact with each other.

In addition, first connection pipe 23*a*, second connection pipe 23*b* and third connection pipe 23*c* are disposed at the plate surface of first cover plate 22*a*. First and second connection pipes 23*a* and 23*b* are disposed side by side in the left-right direction on the lower side of first cover plate 22*a*. Third connection pipe 23*c* is disposed on the upper side of second connection pipe 23*b*. First connection pipe 23*a* is an example of "vapor phase refrigerant inflow part". Second connection pipe 23*b* is an example of "liquid phase refrigerant inflow part". Third connection pipe 23*c* is an example of "liquid phase refrigerant outflow part".

Further, fourth connection pipe 23*d*, fifth connection pipe 23*e* and sixth connection pipe 23*f* are disposed at the plate surface of second cover plate 22*b*. Fourth and fifth connection pipes 23*d* and 23*e* are disposed side by side in the left-right direction on the lower side of second cover plate 22*b*. Sixth connection pipe 23*f* is disposed on the upper side of fifth connection pipe 23*e*. Fourth connection pipe 23*d* is an example of "vapor phase refrigerant outflow part". Fifth connection pipe 23*e* is an example of "returning refrigerant inflow part". Sixth connection pipe 23*f* is an example of "returning refrigerant outflow part".

The first end of first connection pipe 23*a* is connected to pipe 18 connected to the upper part of gas-liquid separator 13. The second end of first connection pipe 23*a* is open to second channel R2. The first end of second connection pipe 23*b* is connected to the first end of sixth connection pipe 23*f* through pipe 18. The second end of second connection pipe 23*b* is open to first channel R1.

The first end of third connection pipe 23*c* is connected to pipe 18 connected to compressor 10. The second end of third connection pipe 23*c* is open to first channel R1. The first end of fourth connection pipe 23*d* is connected to pipe 18 connected to second decompressor 15. The second end of fourth connection pipe 23*d* is open at tenth channel R10.

The first end of fifth connection pipe 23*e* is connected to pipe 18 connected to outer pipe 16*a* of double tube heat exchanger 16. The second end of fifth connection pipe 23*e* is open to eleventh channel R11. The first end of sixth connection pipe 23*f* is connected to the first end of second connection pipe 23*b* as described above. The second end of sixth connection pipe 23*f* is open at eleventh channel R11.

First heat exchanging part 20*a* is composed of first cover plate 22*a*, first to sixth heat transfer plates 21*a* to 21*f*, and first to third connection pipes 23*a* to 23*c*.

Second heat exchanging part 20*b* is composed of second cover plate 22*b*, seventh to twelfth heat transfer plates 21*g* to 21*l*, and fourth to sixth connection pipes 23*d* to 23*f*. First heat exchanging part 20*a* and second heat exchanging part 20*b* are integrally formed.

Next, heat exchange at first heat exchanging part 20*a* is described.

The vapor phase refrigerant flowed out from gas-liquid separator 13 flows through channel R of first heat exchanging part 20*a* as indicated with the solid line arrow illustrated in FIG. 3. More specifically, the vapor phase refrigerant flows into second channel R2 from the lower side through first connection pipe 23*a*, flows through second, fourth and sixth channels R2, R4 and R6 from the lower side toward the upper side, and flows out from the upper side of sixth channel R6 to eighth channel R8.

On the other hand, the refrigerant (hereinafter referred to as merged refrigerant) composed of the returning refrigerant flowed out from sixth connection pipe 23*f* and the liquid phase refrigerant flowed out from gas-liquid separator 13 that are merged with each other at confluence part 18*a* flows through channel R of first heat exchanging part 20*a* as indicated with the broken line arrow illustrated in FIG. 5. More specifically, the merged refrigerant flows into first channel R1 from the lower side through second connection pipe 23*b*, flows through first, third and fifth channels R1, R3 and R5 from the lower side toward the upper side, and flows out from the upper side of first channel R1 through third connection pipe 23*c*.

In this manner, refrigerants with temperatures different from each other flow in channels R adjacent to each other with second to sixth heat transfer plates 23*b* to 21*f* therebetween. In this manner, the vapor phase refrigerant and the merged refrigerant exchange heat through second to sixth heat transfer plates 23*b* to 21*f*.

Next, heat exchange at second heat exchanging part 20*b* is described.

The vapor phase refrigerant flowed into eighth channel R8 from the upper side flows through channel R of second heat exchanging part 20*b* as indicated with the solid line arrow illustrated in FIG. 3. More specifically, the vapor phase refrigerant flowed into eighth channel R8 from the upper side flows through eighth and tenth channels R8 and R10 from the upper side toward the lower side, and flows out from the lower side of tenth channel R10 through fourth connection pipe 23*d*.

Figure 5:
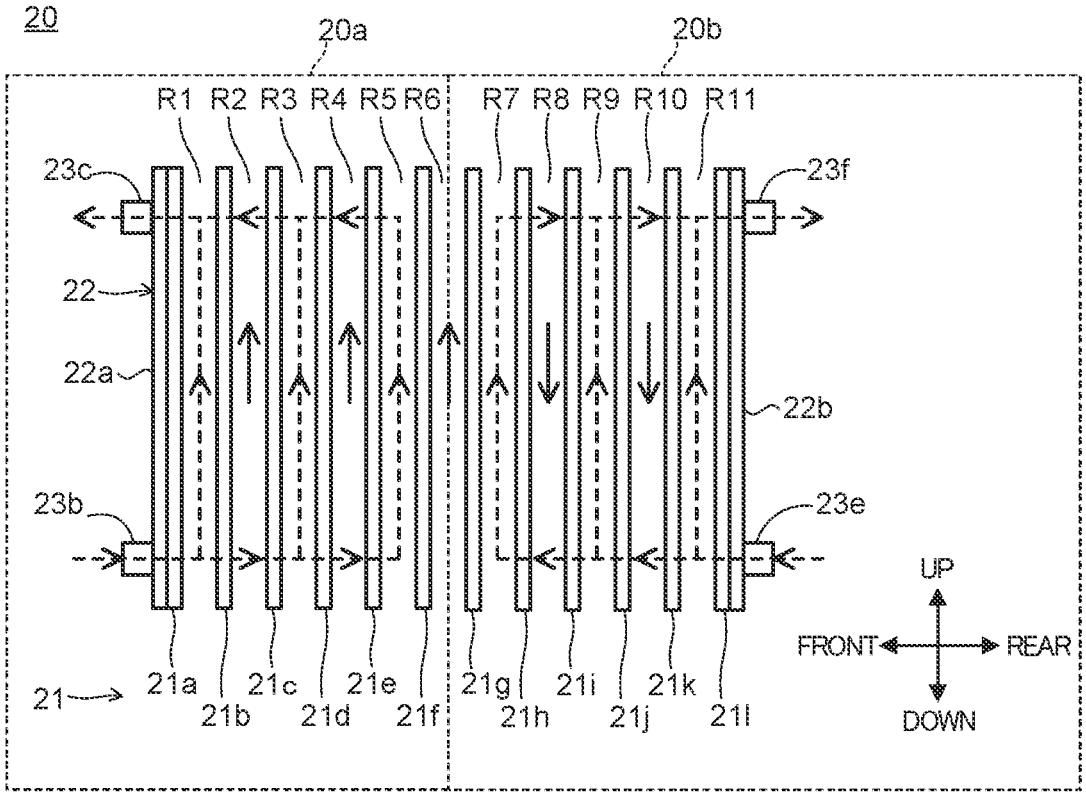
FIG. 5 is a schematic view illustrating a flow of a refrigerant in the plate heat exchanger.

On the other hand, the returning refrigerant flowed out from outer pipe 16*a* of double tube heat exchanger 16 flows through channel R of second heat exchanging part 20*b* as indicated with the broken line arrow illustrated in FIG. 5. More specifically, the returning refrigerant flows into eleventh channel R11 from the lower side through fifth connection pipe 23*e*, flows through seventh, ninth and eleventh channels R7, R9 and R11 from the lower side toward the upper side, and flows out from the upper side of eleventh channel R11 through sixth connection pipe 23*f*.

In this manner, refrigerants with temperatures different from each other flow in channels R adjacent to each other with seventh to eleventh heat transfer plates 21*g* to 21*k* therebetween. In this manner, the vapor phase refrigerant and the returning refrigerant exchange heat through seventh to eleventh heat transfer plates 21*g* to 21*k*.

According to the present embodiment, refrigeration circuit 1 includes gas-liquid separator 13 into which the gas-liquid two-phase refrigerant flowed out from condenser 11 flows, and plate heat exchanger 20 including first heat exchanging part 20*a* where the vapor phase refrigerant flowed out from gas-liquid separator 13 and the liquid phase refrigerant flowed out from gas-liquid separator 13 exchange heat, and second heat exchanging part 20*b* where the vapor phase refrigerant flowed out from first heat exchanging part 20*a* and the returning refrigerant flowed out from evaporator 17 exchange heat. Gas-liquid separator 13 separates the gas-liquid two-phase refrigerant into a vapor phase refrigerant and a liquid phase refrigerant In this manner, refrigeration circuit 1 performs two-stage heat exchange by using one plate heat exchanger 20 for the refrigerant flowing from condenser 11 toward evaporator 17. Thus, the size of the heat exchanger can be reduced, and the low temperature required at evaporator 17 can be obtained in such a manner that the refrigerant flowing toward evaporator 17 efficiently exchanges heat.

In addition, in first heat exchanging part 20*a*, the heat is exchanged between the vapor phase refrigerant flowed out from gas-liquid separator 13, and the mixed refrigerant of the liquid phase refrigerant flowed out from gas-liquid separator 13 and the returning refrigerant flowed out from second heat exchanging part 20*b*.

In this manner, at first heat exchanging part 20*a*, the heat can be exchanged by using the refrigerant of the mixture of the liquid phase refrigerant and the returning refrigerant.

In addition, in plate heat exchanger 20, the plurality of cover plates 22 and the plurality of heat transfer plates 21 are disposed side by side such that their plate surfaces face each other. At the plate surface of first cover plate 22*a* disposed at the first end of plate heat exchanger 20, first connection pipe 23*a* into which the vapor phase refrigerant flows, second connection pipe 23*b* into which the liquid phase refrigerant flows, and the third connection pipe 23*c* from which the liquid phase refrigerant flows out are disposed. At the plate surface of second cover plate 22*b* disposed at the second end of plate heat exchanger 20, fourth connection pipe 23*d* from which the vapor phase refrigerant flows out, fifth connection pipe 23*e* into which the returning refrigerant flows, and sixth connection pipe 23*f* from which the returning refrigerant flows out are disposed.

This increases the ease of the routing of pipe 18.

In addition, refrigeration circuit 1 further includes double tube heat exchanger 16 including the inner pipe into which the vapor phase refrigerant flowed out from second heat exchanging part 20*b* flows and outer pipe 16*a* through which the returning refrigerant that flows into second heat exchanging part 20*b* flows.

In this manner, with double tube heat exchanger 16, the temperature of the refrigerant supplied to evaporator 17 can be further reduced. Moreover, a countercurrent heat exchanger can be made up of the entirety of the heat exchanger system composed of first heat exchanging part 20*a*, second heat exchanging part 20*b* and double tube heat exchanger 16. Thus, the required ultra-low temperature can be obtained by efficiently exchanging heat while making the entirety of the heat exchanger system compact.

The above description of one or more forms of refrigeration circuits is based on the embodiment, but this disclosure is not limited to this embodiment. As long as the main purpose of this disclosure is not departed from, various variations that one skilled in the art can conceive of are applied to this embodiment, and embodiments constructed by combining components in different embodiments may also be included within the scope of one or more embodiments.

Figure 6:
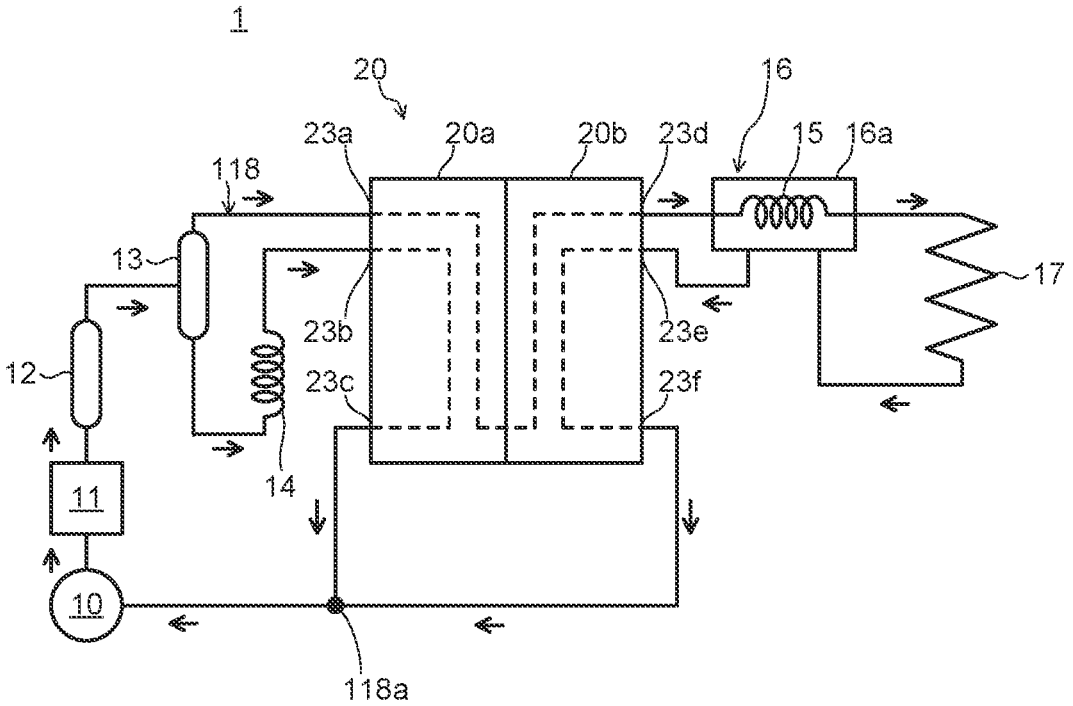
FIG. 6 is a schematic view of a refrigeration circuit of a modification of the present disclosure.

Instead of the above-described configuration in which the merged refrigerant and the vapor phase refrigerant flowed out from gas-liquid separator 13 exchange heat in first heat exchanging part 20*a*, pipe 118 may be configured such that the vapor phase refrigerant flowed out from gas-liquid separator 13 and the liquid phase refrigerant flowed out from gas-liquid separator 13 exchange heat. In this case, as illustrated in FIG. 6, the liquid phase refrigerant flowed out from gas-liquid separator 13 flows into second connection pipe 23*b*. Further, the liquid phase refrigerant flowed out from third connection pipe 23*c* merges at confluence part 118*a* with the returning refrigerant flowed out from second heat exchanging part 20*b*, and returns to compressor 10 as the gas-liquid two-phase refrigerant.

In addition, heat transfer plate 21 may be formed such that the plate surface has a wave shape. In this manner, the flow of the refrigerant can be more easily made turbulent in comparison with the case where the plate surface has a planar shape, and thus the heat exchange efficiency can be improved.

In addition, refrigeration circuit 1 may not include double tube heat exchanger 16. In this case, the refrigerant flowed out from second heat exchanging part 20*b* flows through second decompressor 15 and evaporator 17 in this order. Further, the returning refrigerant flowed out from evaporator 17 flows into second heat exchanging part 20*b*.

Figure 7:
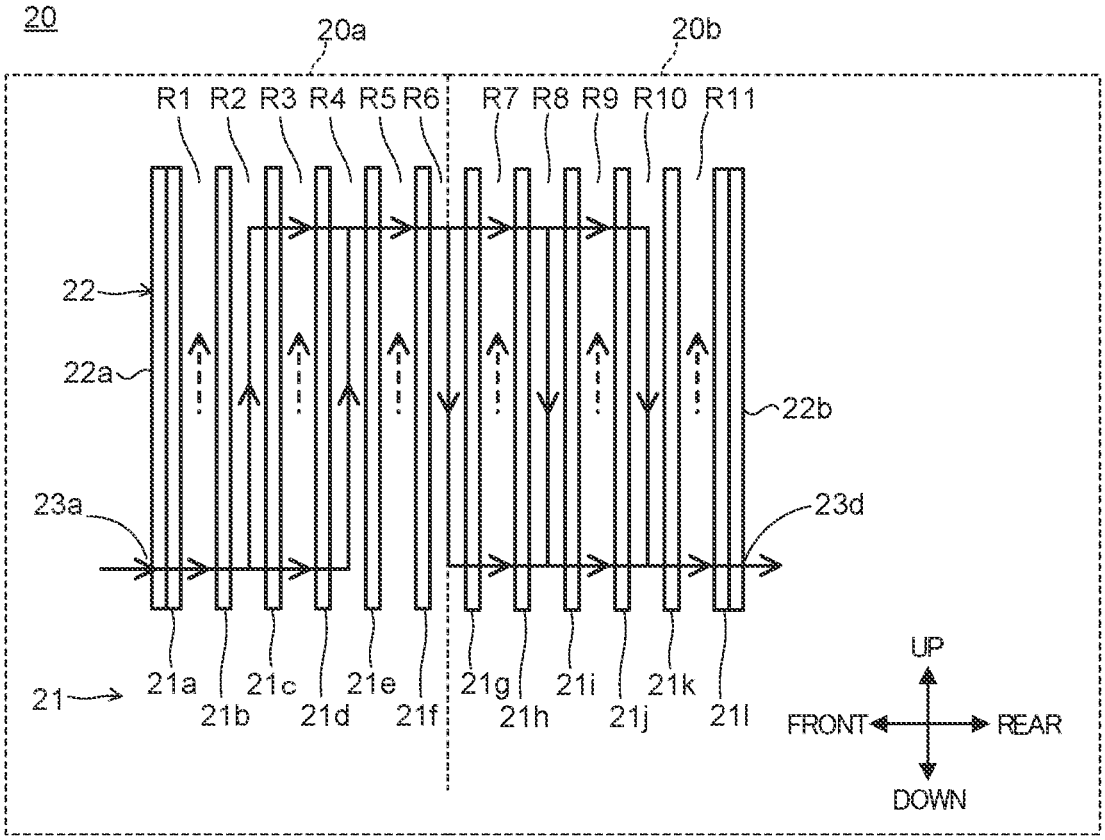
FIG. 7 is a schematic view illustrating a flow of a refrigerant in a plate heat exchanger of a modification of the present disclosure.

In addition, in plate heat exchanger 20, channel R through which vapor phase refrigerant flows may be configured as illustrated in FIG. 7. More specifically, fourth channel R4 and sixth channel R6 are configured to communicate with each other only on the upper side of heat transfer plate 21. In addition, second channel R2 and fourth channel R4 are configured to communicate with each other on the upper side and lower side of heat transfer plate 21. Further, sixth, eighth and tenth channels R6, R8 and R10 are configured to communicate with each other on the upper side and lower side of heat transfer plate 21.

In this manner, the vapor phase refrigerant flowed out from gas-liquid separator 13 flows through channel R of first heat exchanging part 20*a* as indicated with the solid line arrow illustrated in FIG. 7. More specifically, the vapor phase refrigerant flows into second channel R2 from the lower side through first connection pipe 23*a*, and flows through second and fourth channels R2 and R4 from the lower side toward the upper side.

Further, the vapor phase refrigerant flowed through fourth channel R4 flows through channel R of second heat exchanging part 20*b* as indicated with the solid line arrow illustrated in FIG. 7. More specifically, the vapor phase refrigerant flowed through fourth channel R4 flows into sixth channel R6 from the upper side, flows through sixth, eighth and tenth channels R6, R8 and R10 from the upper side toward the lower side, and flows out from the lower side of tenth channel through fourth connection pipe 23*d*.

This application is entitled to and claims the benefit of Japanese Patent Application No. 2021-004787 filed on Jan. 15, 2021, the disclosure each of which including the specification, drawings and abstract is incorporated herein by reference in its entirety.

INDUSTRIAL APPLICABILITY

The refrigeration circuit and the refrigeration device of the present disclosure are widely applicable to ultra-low-temperature freezers and refrigerators.

REFERENCE SIGNS LIST

1 Refrigeration circuit
10 Compressor
11 Condenser
12 Dryer
13 Gas-liquid separator
16 Double tube heat exchanger
17 Evaporator
20 Plate heat exchanger
20*a* First heat exchanging part
20*b* Second heat exchanging part
21 Heat transfer plate (Plate)
22 Cover plate (Plate)
23*a* First connection pipe (Vapor phase refrigerant inflow part)
23*b* Second connection pipe (Liquid phase refrigerant inflow part)
23*c* Third connection pipe (Liquid phase refrigerant outflow part)
23*d* Fourth connection pipe (Vapor phase refrigerant outflow part)
23*e* Fifth connection pipe (Returning refrigerant inflow part)
23*f* Sixth connection pipe (Returning refrigerant outflow part)

The invention claimed is:

1. A refrigeration circuit comprising:

a gas-liquid separator into which a gas-liquid two-phase refrigerant flowed out from a condenser flows, the gas-liquid separator being configured to separate the gas-liquid two-phase refrigerant into a vapor phase refrigerant and a liquid phase refrigerant; and a plate heat exchanger including a first heat exchanging part and a second heat exchanging part, the first heat exchanging part being a part where the vapor phase refrigerant flowed out from the gas-liquid separator and the liquid phase refrigerant flowed out from the gas-liquid separator exchange heat, the second heat exchanging part being a part where the vapor phase refrigerant flowed out from the first heat exchanging part and a returning refrigerant flowed out from an evaporator exchange heat, wherein in the plate heat exchanger, a plurality of plates are disposed side by side in order with plate surfaces of the plurality of plates facing each other, between adjacent two plates, a channel through which the vapor phase refrigerant or the liquid phase refrigerant flows is formed, so that a plurality of channels are formed in order between a first end of the plate heat exchanger and a second end of the plate heat exchanger, a first channel is formed between a first plate and a second plate, a second channel is formed between the second plate and a third plate, a third channel is formed between the third plate and a fourth plate, and a fourth channel is formed between the fourth plate and a fifth plate, the second channel and the fourth channel communicate with each other, and the second channel and the fourth channel do not communicate with adjacent channels, and the third plate forming the second channel has a protruding part bent toward the fourth plate to form a U shape, the U shape has a bottom, at least part of the bottom of the U shape is in direct contact with the fourth plate, and a through hole is formed at the bottom of the U shape.

2. The refrigeration circuit according to claim 1, wherein in the first heat exchanging part, the vapor phase refrigerant flowed out from the gas-liquid separator, and a refrigerant that is a mixture of the liquid phase refrigerant flowed out from the gas-liquid separator and the returning refrigerant flowed out from the second heat exchanging part exchange heat.

3. The refrigeration circuit according to claim 1, wherein at a plate surface of a first plate disposed at the first end of the plate heat exchanger, a vapor phase refrigerant inflow part where the vapor phase refrigerant flows in, a liquid phase refrigerant inflow part where the liquid phase refrigerant flows in, and a liquid phase refrigerant outflow part where the liquid phase refrigerant flows out are disposed, and wherein at a plate surface of a plate disposed at a second end of the plate heat exchanger, a vapor phase refrigerant outflow part where the vapor phase refrigerant flows out, a returning refrigerant inflow part where the returning refrigerant flows in, and a returning refrigerant outflow part where the returning refrigerant flows out are disposed.

4. The refrigeration circuit according to claim 1, further comprising a double tube heat exchanger including an inner pipe through which the vapor phase refrigerant flowed out from the second heat exchanging part flows, and an outer pipe through which the returning refrigerant that flows into the second heat exchanging part flows.

5. A refrigeration device comprising the refrigeration circuit according to claim 1.

6. The refrigeration circuit according to claim 1, wherein a through hole is formed at the fourth plate, and the through hole formed at the bottom of the U shape of the protruding part of the third plate communicates with the through hole formed at the fourth plate.

7. The refrigeration circuit according to claim 6, wherein peripheries of the through hole formed at the bottom of the U shape of the protruding part of the third plate and the through hole formed at the fourth plate are in contact with each other and welded.

8. The refrigeration circuit according to claim 1, wherein the vapor phase refrigerant flowed out from the gas-liquid separator flows from the second channel directly to the fourth channel.

* * * * *